United States Patent [19]

Elsworth

[11] 4,250,685

[45] Feb. 17, 1981

[54] APPARATUS FOR FILLING CAULKING TUBES WITH IMPROVED MANIFOLD FOR FEEDING PLUNGER CAPS

[75] Inventor: Robert M. Elsworth, c/o Sam Gray, Mail Box 19, Georgetown, Exuma, The Bahamas

[73] Assignee: Robert M. Elsworth, Loudonville, N.Y.

[21] Appl. No.: 33,831

[22] Filed: Apr. 27, 1979

[51] Int. Cl.[3] ..... B65B 7/28

[52] U.S. Cl. ..... 53/282; 53/299; 53/306

[58] Field of Search ..... 53/282, 299, 306, 319, 53/264; 221/68; 193/14, 29, 47

[56] References Cited

U.S. PATENT DOCUMENTS

| | | | |
|---|---|---|---|
| 779,544 | 1/1905 | Hyden et al. | 53/299 |
| 1,183,084 | 5/1916 | LaPorte | 53/299 X |
| 3,788,035 | 1/1974 | Geisel | 53/282 |

*Primary Examiner*—Travis S. McGehee
*Attorney, Agent, or Firm*—E. Philip Koltos

[57] ABSTRACT

An improved manifold for feeding plunger caps in an apparatus for filling caulking tubes with liquid compositions in the manifold plunger caps feed means comprising a central feed chute and six more or less chutes coming from said central feed chute imparting horizontal travel of caps and where said central feed chute and said six more or less chutes at the point where they meet are in a vertical plane and said chutes gradually slope from a vertical plane into a horizontal plane at the point where each of the chutes meet the cap receiver means which positions the plunger caps on the back of the filled caulking tubes wherein none of the chutes has a width that is as wide as two diameters of the plunger caps. Preferably, the central feed chute and the drop chutes where they meet the central feed chute are as wide as the 1⅛ plunger cap diameter for the vertical drip and the chutes are as wide as 1⅛ plunger cap diameter for the horizontal travel in the drop chutes.

20 Claims, 4 Drawing Figures

APPARATUS FOR FILLING CAULKING TUBES WITH IMPROVED MANIFOLD FOR FEEDING PLUNGER CAPS

BACKGROUND OF THE INVENTION

The present invention relates to machines for filling caulking tubes with liquid compositions and more particularly the present invention relates to an improved manifold for feeding plunger caps to a caulking tube machine for filling caulking tubes with liquid compositions.

Caulking tube filling machines are well known as well as the caulking tubes themselves. Generally, caulking tubes have a cylindrical body with a plunger cap at one end and a protruding nozzle at the other end. When it is desired to utilize the caulking tube, the tip of the nozzle is cut, the caulking tube is put in the caulking gun, and a ram is activated against the plunger at the rear end of the caulking tube so as to force the composition out of the cut portion of the nozzle of the caulking tube. Generally, there is packaged in such caulking tubes liquid compositions which it is desired to keep from the elements such as, atmospheric moisture, prior to cure and prior to use.

Accordingly, in the case of one-component room temperature vulcanizable silicone rubber compositions, such compositions are packaged in caulking tubes such that the caulking tube keeps atmospheric moisture from entering the caulking tube. As long as atmospheric moisture is not allowed into the caulking tube, the resulting composition in the caulking tube does not cure. However, upon being applied by the method outlined previously, the composition when exposed to atmospheric moisture will cross-link and cure to a silicone elastomer. Such one-component room temperature vulcanizable silicone rubber compositions are useful as sealant compositions, both in construction and industrial applications. Such caulking tubes are filled in caulking tube filling machines. However, it should be noted that the instant invention is not limited solely to caulking tube filling machines for room temperature vulcanizable silicone rubber compositions, but can be applied to any caulking tube filling machines such as, a caulking tube filling machine for filling cheeses and other foods into cartridges for one application or another.

An example of a desirable caulking tube filling machine is to be found in FIG. 1, which generally comprises a frame with a motor which drives a main shaft which drives the appropriate upper shaft through appropriate linkage means. The appropriate upper shaft drives six pistons and cylinders which take measured quantities of liquid composition from the two reservoirs on top of the machine and then later through the appropriate linkages and mechanisms (not shown in FIG. 1), and deposit the measured quantities of liquid composition through passage tubes into the empty caulking tubes that are positioned on a conveyor belt.

It should be noted that one main characteristic of the apparatus of the present invention (as seen in FIG. 1) versus the apparatus of the prior art, is that the apparatus of the present invention (as seen in FIG. 1) is capable of reliably and consistently filling six caulking tubes at a time, while prior art caulking tube filling machines were much more complicated in their cap feed mechanism. The distinction with regard to the advantages of the present invention for putting six caps at a time at the rear end of filled caulking tubes will be discussed below. Suffice to state that mechanisms such as that shown in FIG. 1, were capable and are capable of filling four caulking tubes at a time with liquid composition which was in the reservoirs located at the top of the frame of the apparatus in FIG. 1, which mechanisms are partly hidden in FIG. 1, with measured quantities of liquid composition. The mechanism for filling the caulking tubes which is explained in the copending cases will not be discussed here in detail since it forms no part of the instant invention of this case.

The filled caulking tubes will then travel from the viewer into the plane of the paper into a cap-receiving structure which will reciprocate and take caps as they were fed into it from a cap manifold and position them six at a time on top of the filled caulking tubes, as seen in FIG. 2. Then six air activated pistons will ram the plungers into the appropriate position in the caulking tubes. The six pistons would then retract and the caulking tubes would then pass from the placing of the plunger position to a further position in the apparatus where they would be packaged and shipped from the manufacturing plant.

It was important in this part of the operation of the apparatus which the present case is concerned with, that is, the placing of the plunger caps into the rear end of the filled caulking tubes, that the cap manifold feed the caps properly into the cap-receiving structure for being positioned effectively over the filled caulking tube so that the air activated piston could ram the plunger cap into the back side of the filled caulking tube thus forming a seal.

An example of a prior art plunger cap manifold for feeding plunger caps into the cap-receiving means of the structure shown in FIG. 2, is shown in FIG. 3. Generally, such a plunger cap feed manifold comprises a central chute from an overhead vertical position which gradually branches out to four separate feed chutes which feed chutes slope gradually from a vertical to a horizontal position at the point where the four feed chutes meet the cap-receiving structure means of FIG. 2. The manifold plunger cap feed structure, as that shown in FIG. 3, operated in some respects with efficiency for a machine capable of filling four caulking tubes at a time. However, it would have some problems or disadvantages in that occasionally it would jam such that plunger caps would not come out of one or more of the chutes so that they could be positioned directly over the filled caulking tubes to be pushed into place by the air driven piston, which would result in the air driven piston forcing itself into the liquid composition in the filled caulking tube creating a mess and also creating one or more caulking tubes which had to be discarded until the jamming was corrected.

It was found that a plunger cap manifold structure, such as shown in FIG. 3, could operate better by having air pressure forced against the upper plunger caps in the vertical part of the structure. This would create sufficient pressure so that the plunger caps would feed themselves into the appropriate positions over the filled caulking tubes in the plunger cap-receiving structure. However, even then occasionally such plunger caps would jam in one or more chutes in the manifold plunger cap structure of FIG. 3. However, when this same structure was taken and tried to be applied so that there would be six chutes coming off in the same general configuration, as shown in FIG. 3, so that the manifold could feed six plunger caps at a time into the cap-receiving structure of the caulking tube filling machine, then even with air pressure such an apparatus would frequently jam and would work poorly. Accordingly, it was highly desirable to design a manifold structure which could feed plunger caps to the cap-receiving structure in the caulking tube filling machine at the appropriate rate and six at a time so as to be placed over six filled caulking tubes at a time with facility and efficiency and without the plunger caps jamming in the manifold.

It was also desirable to simplify the structure of the coupling in the cam structure as well as the cam follower in the drive means for driving the cap-receiving structure of a caulking tube filling machine in accordance with the instant invention.

Accordingly, it is one object of the present invention to provide for a simple but efficient manifold structure for feeding six plunger caps at a time to the cap-receiving structures of a caulking tube filling machine.

It is an additional object of the present invention to provide for a manifold for feeding six plunger caps at a time to a cap-receiving structure without the plunger caps jamming in the manifold structures.

It is still an additional object of the present invention to provide for a simple structure for combining the coupling from a main drive shaft of a caulking tube filling machine with a cam and cam follower linkage in the linkage means that drives the cap-receiving structure means of a caulking tube filling machine.

These and other objects of the present invention are accomplished by means of the disclosure set forth in the Figures below.

FIGURES

Figure 1:
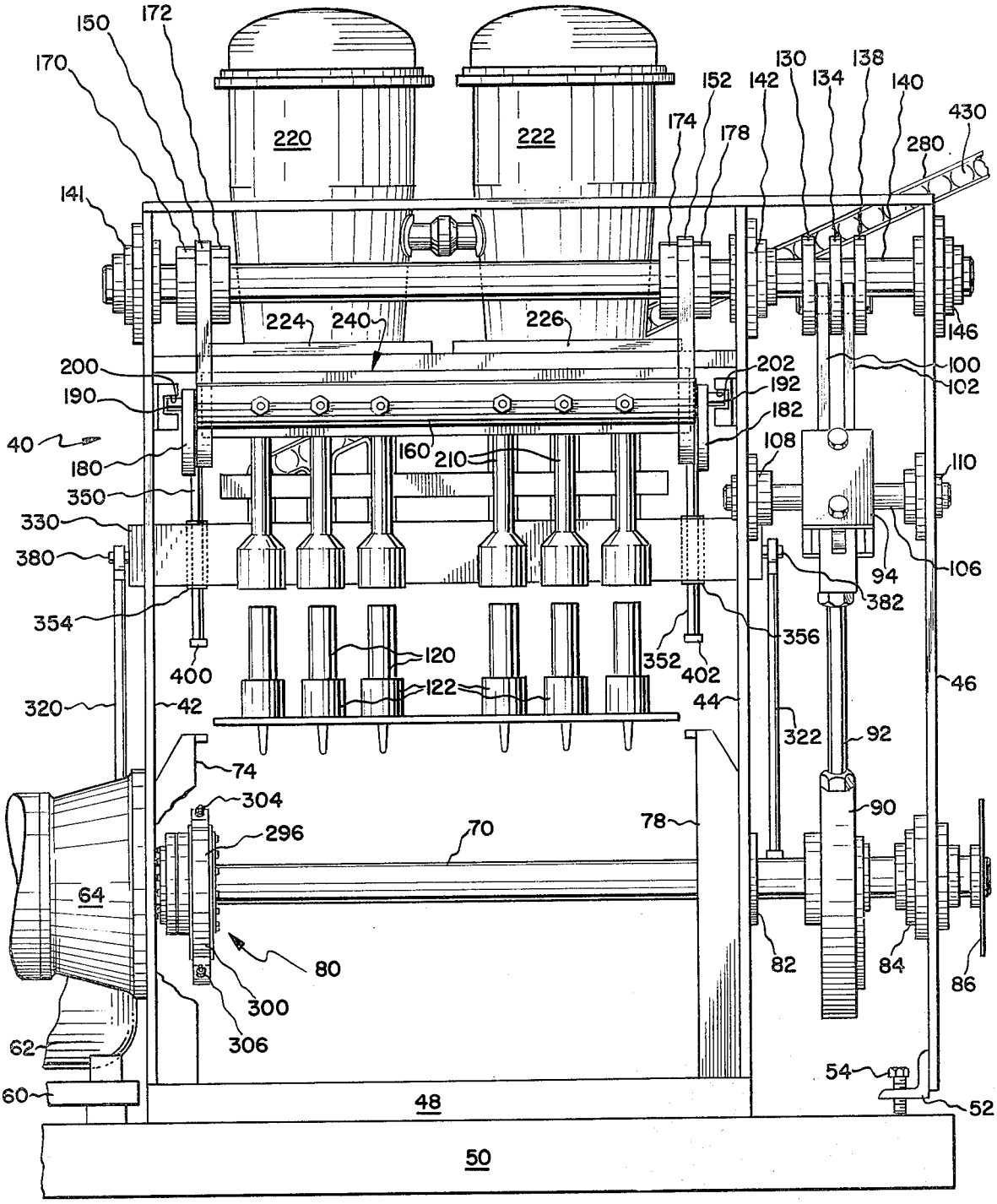
FIG. 1 is a front view/partially sectional view of the caulking tube filling machine of the instant case showing in the background the manifold that is utilized to feed plunger caps, six at a time, to the apparatus.

These and other advantages of the apparatus of the Figures disclosed above will be discussed below.

SUMMARY OF THE INVENTION

There is provided by the present invention and in accordance with the above objects, an apparatus for filling caulking tubes with liquid compositions with an improved manifold for feeding plunger caps to be inserted on the rear end of caulking tubes, comprising, a frame;

drive means at the lower end of said frame for driving conveyor belt means having therein empty caulking tubes;

feed means being driven by said drive means for feeding said liquid composition into six of said empty caulking tubes at a time;

linkage means at the lower end of said frame being driven by said drive means;

cap-receiver means being driven by said linkage means for positioning six plunger caps at a time at the ends of said filled caulking tubes;

piston and cylinder means activated by drive means for forcing six of said plunger caps at a time into the back of said six filled caulking tubes, and plunger cap manifold means for feeding plunger caps continuously, six at a time, to said cap-receiver means where the manifold has six chutes going to said cap-receiver means wherein said chutes are fed by a single central feed chute wherein the plane of six chutes is vertical wherein they are joined to a single central feed chute and generally slope into the horizontal plane where each of the six chutes meet the cap-receiver means and wherein none of the chute sections have a width that is as wide as two diameters of the plunger caps.

Preferably, the width of such chutes, both the central feed chute and the six chutes emanating therefrom, is such that the plunger cap manifold is as wide as $1\frac{1}{8}$ times the plunger cap diameter for the vertical drop in the chutes and is as wide as $1\frac{1}{8}$ times the plunger cap diameter for the horizontal travel in the six chutes.

In addition, preferably, said plunger cap manifold starting from the first chute on one side closest to the supplying feed chute, the additional chutes are pitched an additional diameter of the plunger cap above the next succeeding chute for each succeeding chute such as, the second chute is one diameter lower at the point of central drop from the point the central drop starts in the first chute, and a similar relation exists between each succeeding chute and the chute before it for the six chutes.

Preferably, the liquid composition that is filled by the apparatus of the instant case is a one-component room temperature vulcanizable silicone rubber composition.

DESCRIPTION OF THE PREFERRED EMBODIMENT

It should be noted that the improved apparatus of the instant case is especially suited for filling caulking tubes with silicone compositions. However, the present invention is not limited to improved apparatus only for filling caulking tubes with silicone compositions, but is directed to improved apparatus for filling caulking tubes with any kind of liquid compositions or for providing caps for other containers whether screwed in place or crimped out.

Examples of other compositions besides silicone compositions which can be utilized with the instant invention to fill caulking tubes are, for instance, grease, putties, butyl caulking process cheese, cake frosting, cosmetics or food containers now done one at a time.

It should be noted that the advantage of the instant application is to present an improved apparatus for allowing the plunger caps to pass onto the rear end of a caulking tube in a caulking tube filling machine and be positioned in the rear end of a caulking tube without any malfunction of the machine and without the machine jamming and resulting in caulking tubes without plunger caps at the rear end.

In the preferred embodiment of the instant case the caulking tube filling machine or apparatus of the instant case is especially suited to filling caulking tubes with silicone compositions and more particularly to filling caulking tubes with one-component room temperature vulcanizable silicone rubber compositions. Such one-component room temperature vulcanizable silicone rubber compositions generally comprise a silanol end-stopped diorganopolysiloxane polymer having a viscosity varying from 500 to 1,000,000 centipoise at 25° C. where the organo groups are selected from monovalent hydrocarbon radicals; a filler which can be reinforcing filler such as, fumed silica or precipitated silica, or an extending filler such as, diatomaceous earth, lithopone, zinc oxide, iron oxide and etc.

To this basic mixture there is added a cross-linking agent which may be an acyloxy functional silane such as, methyltriacetoxysilane, or an alkoxy functional silane such as, methyl trialkoxysilane or methyltrimethoxysilane. There is then added, in addition to the cross-linking agent, to the composition a metal salt of a carboxylic acid wherein the metal varies from lead to manganese in the Periodic Table, and more particularly there is added a tin salt of a carboxylic acid as the catalyst such as, dibutyl tin dilaurate or dibutyl tin oxide. The filler comprises anywhere from 5 to 200 parts by weight of the base silanol polymer; the cross-linking agent generally comprises anywhere from 1 to 15 parts by weight per 100 parts of the silanol end-stopped polymer, and the metal salt of a carboxylic acid generally is present in a concentration varying anywhere from 0.01 to 5 parts by weight per 100 parts of the silanol polymer in the composition. The composition may have other ingredients in it such as, adhesion promoters, such as, silylisocyanurates; flame retardant additives and etc.

In the case where the cross-linking agent is methyltrimethoxysilane or an alkoxysilane, then there is preferably utilized a titanium chelate as the catalyst in the concentrations disclosed previously for the tin salt. These resulting ingredients are taken and mixed in an anhydrous state or substantially anhydrous state and maintained packaged in such anhydrous state in caulking tubes and the like. The caulking tubes and other tubes are meant to keep atmospheric moisture from coming into contact with the material inside the tubes. When it is desired to cure the composition, the composition is exposed to atmospheric moisture and will slowly cure to a silicone elastomer, complete cure taking place in about 24 hours.

It should be noted that the instant invention is related to that portion of a caulking tube filling machine wherein the plunger caps are positioned and forced into place in the rear end of the caulking tube. The present invention does not relate to that part of a caulking tube filling machine dealing with the filling of the caulking tube with material. This is the subject matter of other cases by the same inventor as the instant case and will not be discussed in detail in the present case.

Figure 3:
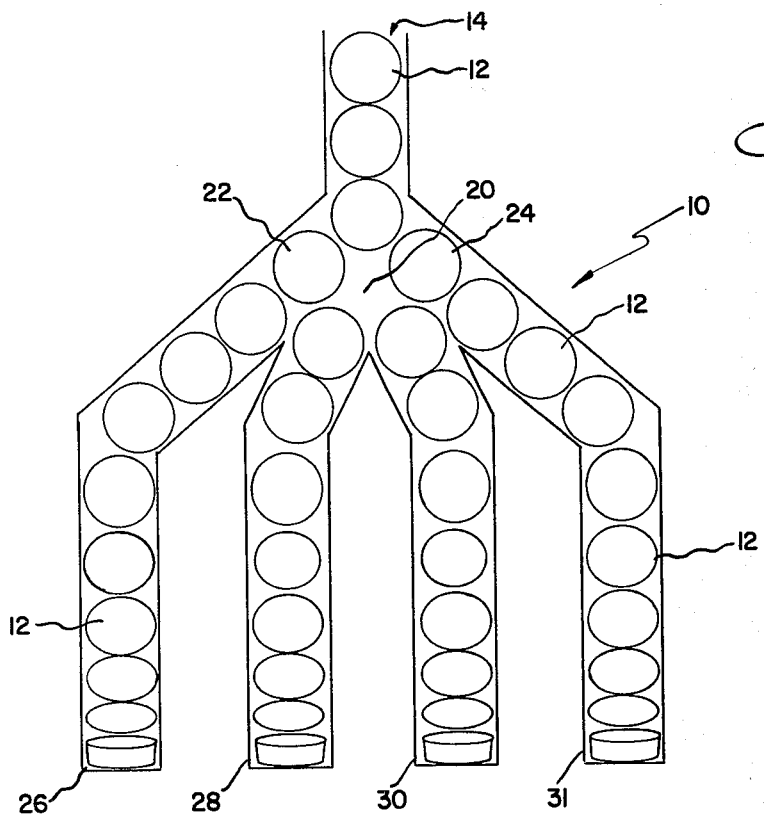
FIG. 3 is a cross-sectional view/partially skematic view of a prior art cap manifold feeding plunger caps in a caulking tube filling apparatus.

FIG. 3 is a cross-sectional view of a manifold for filling or supplying four plunger caps at a time to a caulking tube filling machine. This is one of the prior art manifold that is utilized to supply plunger caps to a caulking tube filling machine in accordance with the known prior art. As discussed previously, such plunger caps use to jam in the manifold and occasionally as the result of such jamming a plunger cap would not be positioned on a caulking tube and the ram or piston which was suppose to force the plunger cap into position in the rear end of the caulking tube would force itself into the composition in the rear end of the caulking tube creating an unsightly mess fouling the apparatus as well as causing the caulking tube to be discarded.

An improvement in the apparatus (10) of FIG. 3 was to force the air behind plunger caps (12) at point (14), thus creating a positive pressure on the plunger caps in the apparatus. This helped in minimizing the jamming of the manifold apparatus in presenting plunger caps to the caulking tubes for which a plunger cap was needed. However, it should be noted in the central area of the manifold (20) there was an area where more than two plunger caps (22) and (24) could be positioned and as a result the apparatus had a tendency to jam. However, as pointed out previously, this was largely avoided for a four caulking tube machine by the use of positive pressure at point (14) so as to force all the plunger caps through the four passageways or chutes (24), (26), (28) and (30) in the apparatus (14) without the plunger caps (12) jamming in the apparatus. However, while this construction was suitable for a caulking tube filling machine in which the manifold apparatus (10) presented only four plunger caps at a time through four chutes (24), (26), (28) and (30) to four caulking tubes at a time to be capped at the end with plunger caps, it was found that such an apparatus would not work for a six or more caulking tube machine, that is, a machine in which six plunger caps were placed at the end of filled caulking tubes at a single time, and this was the case even though positive pressure was utilized at point (14) in the manifold construction similar to that of FIG. 3, which had six chutes and that even with positive air pressure at point (14) the apparatus would continually jam and would malfunction.

Accordingly, it was highly desirable to come up with a manifold construction which would supply six plunger caps at a time to six filled caulking tubes to be capped at one time with plunger caps. The six chute manifold was necessitated by the advent and invention of a caulking tube filling machine which was capable reliably of filling six caulking tubes at a single time. As stated previously, the filling of the caulking tubes is not the invention of the instant case but the supplying and reliably placing of the plunger cap at the rear end of the caulking tube so that it could be fixed in position or placed in position at the rear end of the caulking tube forms the subject matter of the instant case.

Going to FIG. 1, so as to gain some visualization of the apparatus, FIG. 1 is a back view of a caulking tube filling machine. The caulking tube filling apparatus comprises, a frame (40) of the apparatus having sides (42), (44), (46), sides (42) and (44) being located on platform (48) lying on ground (50). Side (46) being bolted or appended to the ground (50) through bracket (52) and bolt (54). On base (50) there is also platform (60) on which is located motor (62) which drives gear box (64) which drives main drive shaft (70). Main drive shaft (70) is supported on side (42) by a rigid coupling which is supported by gear box (64) and is supported on side (44) by bearing (78) and bearing (84) in side plate (96). Also, on main drive shaft (70) there is coupling and cam arrangement (80) whose parts and function will be described below.

However, going into the general operation of the machine, main drive shaft (70) moves in bearing surface (82) in roller bearing (78) mounted in side (44), as well as roller bearing (84) in side (46). Main drive shaft (70) extends through side (46) in bearing surface (84) and has a conveyor drive sprocket (86) at one end. In addition, main drive shaft (70) through cam (90), not completely shown in FIG. 1, drives lever (92) and through yoke (94), arms (100) and (102) in a reciprocating motion. The reciprocating motion to arms (100) and (102) is imparted by yoke (94) by means of an arrangement, not shown, including shaft (106) which turns in bearing surfaces (108) and (110) in sides (44) and (46), respectively.

It should be noted that the caulking tubes (120) are located in the receptacles (122) lying on conveyor belt (124) which is driven by means not shown in a direction that moves from the viewer into the plane of the paper.

Rocker arms (100) and (102) which are located in bearings (130), (134) and (138) drive secondary shaft (140) which rides in bearing surfaces (141), (142) and (146), in sides (42), (44) and (46), respectively. Secondary drive shaft (140) drives levers (150) and (152) in a reciprocating motion so as to drive cylinder (160) in that manner. Levers (150) and (152) are keyed to and held in position on secondary shaft (140) by collars (170), (172), (174) and (178), respectively. Levers (150) and (152) reciprocate arms (180) and (182) having pins (190) and (192) which travel in channel members (200) and (202) so as to align the motion of rocker arms (180) and (182) by the proper amount, that is, so that (180) and (182) have the proper amount of travel. Cylinder (160) which is driven by arms (180) and (182) drives pistons (not shown) so as to deposit measured quantities of a liquid composition into the caulking tubes, through passage tubes (210) into caulking tubes (120). From pressurized containers liquid composition, which can be a liquid silicone composition as disclosed previously, is forced into reservoirs (220) and (222) which rests on plates (224) and (226). By pressure and by the action of the foregoing cylinder and pistons, mentioned previously but not shown in the Figures, the silicone liquid composition or other type of composition is forced from reservoirs (220) and (222) through cavities on a core and block means (240), only partially shown in FIG. 1, so that such cylinder and piston means take measured quantities of the liquid composition and then force such measured quantities of liquid composition through the foregoing block and core means (240) into the passage tubes (210) and eventually into the six caulking tubes (120) being filled at a single time. However, this filling mechanism as well as the block and core means form no part of the instant invention and will not be described here in detail.

It should also be noted with respect to reservoir (220) and (222) that they are connected by pipes to a supply source. However, the reservoirs (220) and (222) form no part of the instant invention and accordingly they will not be discussed here in detail.

In addition, as seen in FIG. 1, there is the manifold (280) with an upper vertical chute of the manifold (282) which leads down to individual chutes located behind passage tubes (210). Before going into the discussion as to the construction of the advantageous manifold of the instant invention, it is necessary to discuss the means by which the plunging caps are placed in the caulking tubes.

Figure 2:
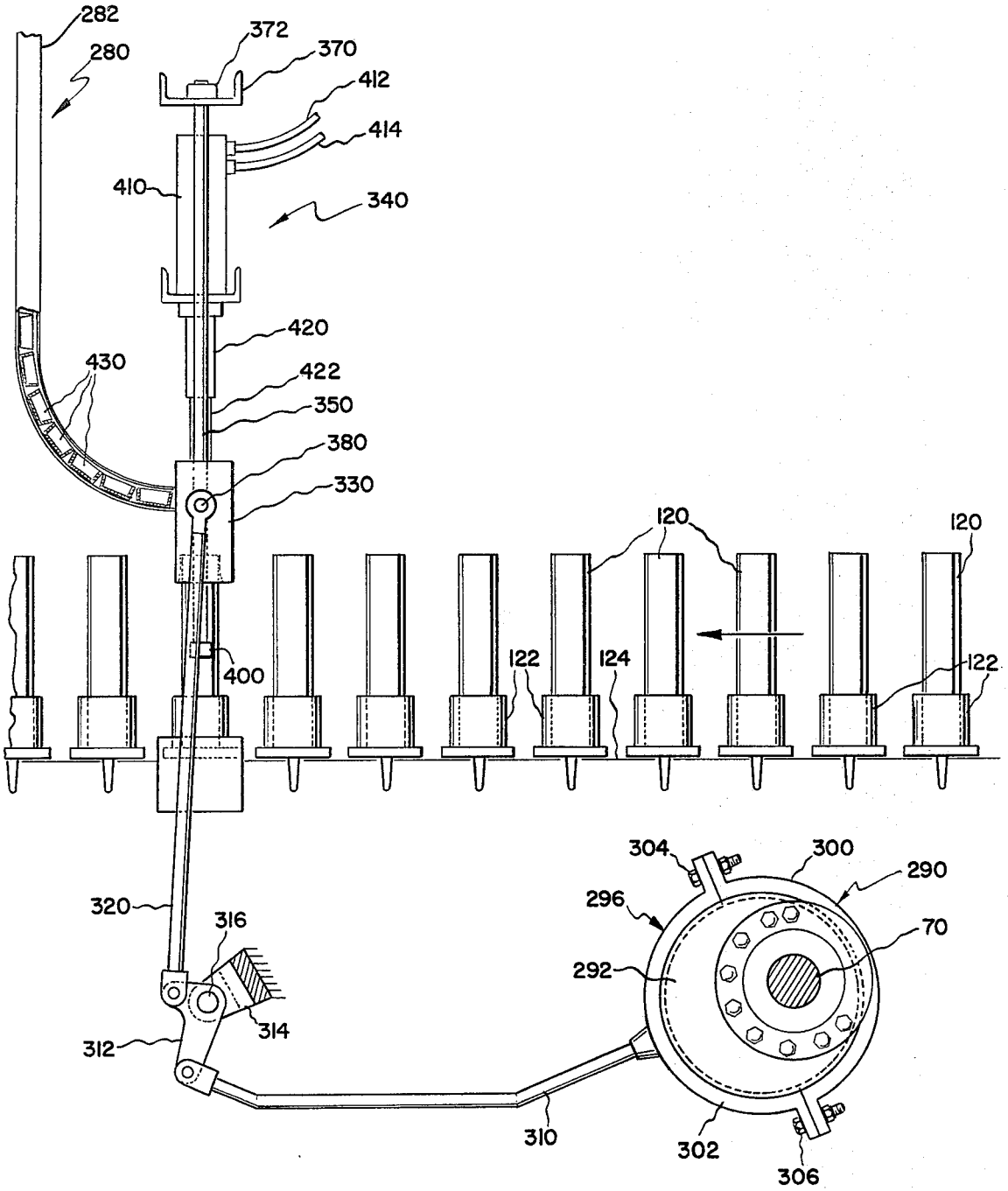
FIG. 2 is a partially cross-sectional view/partially skematic view of the plunger cap insertion portion of an apparatus for filling caulking tubes with a liquid composition showing the position of the cap manifold feeding plunger caps to the cap-receiving structure in the apparatus.

As is seen in FIG. 2, shaft (70) which is propelled by motor (62) through gear box (64) has in it a coupling (290) which is bolted to the cam (292) which moves in cam follower (296) which cam follower comprises two sleeves (300) and (302) held together by bolts (304) and (306), so as to drive bar (310) in a reciprocating motion.

As shown both in FIG. 1 and FIG. 2, one aspect of the present invention is to have such a cam (292) attached directly to the coupling (290) instead of being separate and result in a more efficient utilization of the drive means in the machine. Previous to the present invention in such caulking tube apparatuses, the couplings were separate from the cam that was utilized to drive the plunger positioning structure or custom built to incorporate a coupling. Most packaging machines for medium and low viscosities are built with sleeve bearings for linkage pins and shaft bearings. When such packaging machine designs were put in service with silicone compounds they had relatively short life due to the pressures involved in handling the silicone compounds. Also, they required relatively more power to move the necessary linkages required to transfer the compounds from supply reservoirs into the caulker packages than other materials. An eccentric steel main drive cam with a heavy manganese bronze follower was tried and whereas they performed better than the cast iron followers previously used (and which were rejected for failure) they still had limited service life with premature wear allowing loss of precise motion control. The instant invention was to add a heavy duty roller bearing between the eccentric cam and the cam follower. This has practically eliminated wear.

Accordingly, with the advantageous design of the apparatus of the instant case, the cam (292) is placed directly on a standard coupling (29), for example, such as sold by Browning Inc., and results in a saving cost and construction time of the apparatus. Drive bar (310) reciprocates and drives fulcrum (312), as in established practice, which reciprocates fulcrum shaft (314) through pin or key (316), that is, fulcrum (312) is allowed to reciprocate back and forth as driven by drive bar (310) on support (314) by means of (316) to which it is keyed or pinned. In this manner, fulcrum (312) moves guidebar (320) being shown in FIG. 2, and guidebar (322) being shown in FIG. 1, there being one guidebar on each side of the apparatus.

Fulcrum (314) and guidebar (320) reciprocate in a well known manner to a worker skilled in the art so as to move cap receiving structure (330) up and down so as to take caps from manifold (280) and position them appropriately at the top of the caulking tubes (120) for action by the piston positioning means (340) as will be explained more fully below. Cap receiving structure (330) travels on guided rods means (350) and (352) which travel on a sleeve (354) and (356) in cap receiving structure (330), shown in dotted lines in FIG. 1. Accordingly, cap receiving structure (330) driven by drive bar (320) and (322) will reciprocate up and down as guided by guidebars (350) and (352) which pass through or guide cap receiving structure (330) by passing through and guiding and supporting cap receiving structure (330) by means of sleeves (354) and (356). Guidebar (350), as seen in FIG. 2, is supported at the upper end in guidebar support (370), and is kept in position from passing through guide support (370) by means of fixture (372). Guide and drive bar (320) and (322) drive cap receiving structure (330) by means of drive and guidebar (320) and (322) being attached to pins (380) and (382) on cap receiving structure (330), respectively, as shown in FIG. 1.

Guidebar (350) and (352) also have fixtures (400) and (402) respectively, at the bottom end of the guidebars so as to prevent the cap receiving structure (330) from going beyond that point on guidebars (350) and (352) if the cap receiving structure (330) should ever fall to that position. After cap receiving structure (330) has positioned the plunger cap on the rear end of caulking tube (120), as shown in FIG. 2, air cylinder (410) through air inlet and outlet means (412) and (414) moves piston (420) and piston extension (422) so as to force the plunger cap (430), shown in dotted lines, into the rear end of the caulking tube (120); there being six such air cylinders (414) with pistons (420) and piston extensions (422) for driving six such plunger caps (430) into position at the rear end of six caulking tubes at one time. The piston extension (422) of piston (420) then retracts upward into air cylinder (414) and the caulking tubes pass from that station in the apparatus to the next station so that they can be eventually taken and passed into cartons for shipment to customers.

Figure 4:
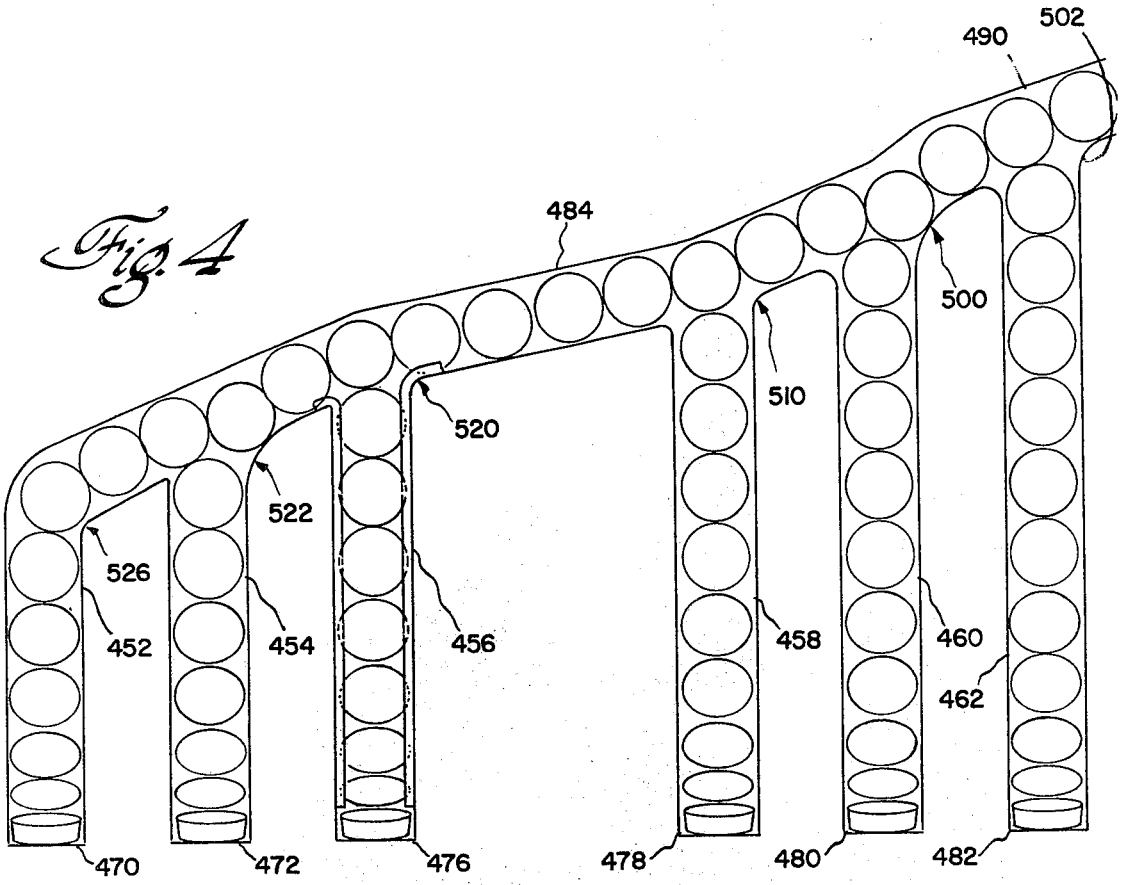
FIG. 4 is a partially cross-sectional view/partially skematic view of the plunger cap manifold of the instant case for feeding six plunger caps at a time to the cap-receiving structure of a caulking tube filling machine of the present invention.

Cap receiving structure (330) details will not be shown since they are well known in the art and form no part of the present invention. However, what does form a part of the present invention and is basically the present invention is the design of the cap manifold (280), shown in FIGS. 1 and 2, and more clearly shown in the cross-section in FIG. 4.

As can be seen, the central chute (450) which is connected to upper chute (282), as well as the upper part of chutes (452), (454), (456), (458), (460) and (462) is vertical with the chutes sloping to a generally horizontal position at the position where the cap receiving structure (330), that is, at the bottom part of the chutes (452), (454), (456), (458), (460) and (462) at points (470), (472), (476), (478) and (482), the chutes are horizontal. It is at this point that the chute presents to the cap receiving structure (330) caps for positioning at the rear end of the caulking tube. Accordingly, in the manifold (280), the central feed chute (480) will be in a vertical plane and the upper parts of chutes (452), (454), (456), (460) and (462) will be in a vertical plane while such chutes will gradually slope such that the foregoing points of those chutes, respectively, (470), (472), (476), (478), (480), and (482) will be on a horizontal plane so that the caps will feed by gravity feed from a vertical position to a horizontal position for being positioned at the end of a caulking tube by cap receiving structure (330). Also, air pressure can be utilized at point (490) in central feed chute (480) or at point (282) so as to force and give a positive pressure to the caps in the foregoing chutes. However, this is not the novel part of the instant case.

What is the novel part of the instant case lies in the design of the chute, and there are two aspects in the design of the chute. First of all, for each succeeding chute, the point of vertical descent in the chute taking as (500), in FIG. 4, leaves at least one cap diameter below the point of vertical descent in the preceding chute such as, (502) in chute (462) as distinguished from (500) in chute (460). Accordingly, in chute (458) the point of vertical descent (510) will be at least one diameter of a cap plunger below the point of vertical descent of the preceding chute (460), the point of descent being (500) in said chute. In the same way, the point of vertical descent (520) in chute (456) is at least one cap diameter below the initial point of vertical descent (510) in chute (458). In the same way, the point of initial vertical descent (522) in chute (454) is at least one cap diameter below the initial point of vertical descent (520) in chute (456). In the same way, the point of initial vertical descent (526) in chute (452) is at least one cap diameter below the point of initial vertical descent (522) in chute (454).

Accordingly, the design feature in the manifold of the instant case to prevent binding or jamming of the caps in the chutes is that for each succeeding chute the point of vertical descent for the succeeding chute is at least one cap diameter below the point of initial vertical descent in the preceding chute.

The other point of design in the chutes of the instant case is that in the vertical descent part of the chute there be a clearance of at least $\frac{1}{8}$ of a diameter of a cap for the vertical drop chute between the cap diameters and the side of the chute, but not as much clearance so as to be as large as that of the diameter of the cap plunger and for the horizontal clearance that there be at least $\frac{1}{8}$ of a diameter of a cap clearance between the cap plungers and the sides of the chute but not to be as large as the diameter of a cap plunger. Preferably, the clearance in the vertical drop in the chute varies from 1/16 to 3/16" and the clearance in the horizontal part of the chute varies from 1/16 to 6/16".

It should also be noted that there is nowhere in the entire chute sufficient distance between the walls of the chute such that there can fit two diameters or two cap plungers side-by-side without having a wall ajoining them; that is, the diameters or spaces in the chutes are such that there is no place in the chute which is as large from wall-to-wall of a chute or from diagonal wall of the chute to other parts of the chute which is as large as two diameters of the cap plungers. Preferably, the clearances are within the preferred limits set forth above.

Accordingly, with these design features, that is, with the point of descent in each succeeding chute measured, as outlined above, and with the caveat that there be no point between two wall chutes in which there can fit at least two plunger caps and with the proviso that the clearance be within the preferred limits set forth above, there is designed a chute in accordance with the instant invention in which the caps do not jam and in which there is a minimal jamming of plunger caps in the feeding of such plunger caps in the caulking tube filling machine of the instant case to the rear end of caulking tube as positioned by the cap receiving structure (330) and as inserted and placed into the rear end of the caulking tube, as was discussed previously.

With the advantageous chute manifold of the instant case, caps can be supplied to six or more or less caulking tubes at one time so as to be inserted at the rear end of the caulking tubes with a minimum of jamming of the caps in the manifold apparatus and in the chutes of the apparatus and as a product or result of such a design there results a minimum of machine down time and discarded caulking tubes which are discarded because the plunger cap was not inserted properly into the rear end of the caulking tube.

I claim:

1. An apparatus for filling caulking tubes with liquid compositions with an improved manifold for feeding plunger caps to be inserted on the rear end of the caulking tubes, comprising, a frame;

drive means at the lower end of said frame for driving conveyor belt means having thereon empty caulking tubes;

feeding means being driven by said drive means for feeding said liquid composition into six of said empty caulking tubes at a time;

linkage means at the lower end of said frame being driven by said drive means;

cap receiver means driven by said linkage means for positioning six plunger caps at a time at the ends of said filled caulking tubes;

piston and cylinder means activated by drive means for forcing six of said plunger caps at a time into the back of said six filled caulking tubes; and plunger cap manifold means for feeding plunger caps continuously, six at a time, to said cap receiver means where the manifold has six chutes going to said cap receiver means wherein said chutes are fed by a single central chute wherein the plane of said six chutes is vertical wherein they are joined to said single central chute and slopes into the horizontal plane where each of the six more or less chutes meet the cap receiver means and wherein none of the chutes have a width that is as wide as two diameters of the plunger caps.

2. The apparatus of claim 1 wherein the caps are fed to the cap station rolling on edge and said plunger cap manifold channel is as high as $1\frac{1}{8}$ diameters of the top of the plunger cap and the horizontal width $\frac{1}{8}$ diameter wider than the cap height and the vertical drop chute is as wide as the plunger cap diameter plus $\frac{1}{8}$ diameter for the horizontal travel in the six chutes.

3. The apparatus of claim 2, wherein in said plunger cap manifold starting from the first chute on one side closest to the in feed chute the additional chutes are pitched an additional diameter of the plunger caps for each succeeding chute such that the second chute is one diameter lower from the point the second chute is connected to the distribution chute as compared to the point where the first chute is connected to the distribution feed chute and a similar relation exists between each succeeding chute and the chute before it, for the two or more chutes.

4. The apparatus of claim 3 wherein air pressure is intermittently applied on the plunger caps in said plunger cap manifold so that the plunger caps are forced with a positive force out of said chutes.

5. The apparatus of claim 4 wherein there are guide bars on each side of said cap receiver means for controlling the travel of said cap receiver means.

6. The apparatus of claim 5 wherein piston and cylinder means comprises two or more air activated pistons which forces the plunger caps two or more at a time into the rear end of said filled caulking tubes.

7. The apparatus of claim 6 wherein said linkage means comprises coupling means and a cam and cam follower means which drives through a first rod, a fulcrum, which in turn drives such rods which reciprocates said cap receiver means.

8. The apparatus of claim 7 wherein said coupling means and said cam means are all fabricated into one unit by adding an eccentric cam to a standard coupling.

9. The apparatus of claim 8 wherein the liquid composition being filled is a one-component room temperture vulcanizable silicone rubber composition.

10. An improved apparatus for filling caulking tubes with liquid compositions with an improved manifold for feeding plunger caps to be inserted in the rear end of the caulking tubes, comprising, a frame;

drive means at the lower end of said frame for driving conveyor belt means having thereon filled caulking tubes;

linkage means at the lower end of said frame being driven by said drive means;

cap receiver means driven by said linkage means for positioning two or more plunger caps at a time at the ends of said filled caulking tubes;

piston and cylinder means activated by said drive means for forcing two or more of said plunger caps at a time into the rear end of said two or more filled caulking tubes at one time, and plunger cap manifold means for feeding two or more plunger caps at a time continuously into said cap receiver means comprising the improvement wherein the manifold has two or more chutes going to said cap receiver means wherein such two or more chutes are fed by a single central chute wherein the plane of the single central chute and the two or more feed chutes therefrom are vertical initially and wherein the two or more chutes slope gradually into the horizontal plane where each of the two or more chutes meet the cap receiver means and wherein none of the chutes have a width that is as wide as two diameters of the plunger caps.

11. The improved apparatus of claim 10 wherein said plunger cap manifold is as wide as the plunger cap diameter plus $\frac{1}{8}$ diameter for the vertical drop in the chutes and is as wide as the plunger cap diameter plus $\frac{1}{8}$ diameter for the horizontal travel on the two or more chutes.

12. The improved apparatus of claim 10 wherein the two or more chutes are six chutes and said plunger cap manifold starting from the first chute on one side closest to the central feed chute wherein the additional chutes are pitched an additional diameter of the plunger cap for each succeeding chute such that the second chute is one diameter lower from the point the first chute is connected to the central chute as compared to to the initial point of vertical descent of the point, and a similar relation exists between each succeeding chute and the chute before it for the six chutes.

13. The improved apparatus of claim 12 wherein air pressure is intermittently applied on the plunger caps in the plunger cap manifold chutes so that the plunger caps are forced with a positive pressure out of such chutes.

14. The improved apparatus of claim 13 wherein slide bars are located on each side of said cap receiver means for controlling the travel of said cap receiver means in said apparatus.

15. The improved apparatus of claim 14 wherein piston and cylinder means comprise six air activated pistons which force the plunger caps, six at a time, into the rear end of said filled caulking tubes.

16. The improved apparatus of claim 15 wherein said linkage means comprises coupling means and cam means and cam follower means which drives through a first rod, a fulcrum, which in turn drives a second rod which reciprocates the cap receiving means so that the cap receiving means positions the plunger caps on the rear end of said caulking tubes for the piston means to force the plunger caps into the rear end of said caulking tubes.

17. The improved apparatus of claim 16 wherein said coupling means, said cam means and said cam follower means are all in one unit.

18. The improved apparatus of claim 17 wherein the liquid composition which is present in said filled caulking tubes is a one-component room temperature vulcanizable silicone rubber composition.

19. An improved cap manifold for feeding two or more caps at a time to a series of cap receiving units for doing additional work on the caps without jamming at any time, comprising, a central feed chute handling caps rolling on edge which lies in a vertical plane, six feed chutes coming from the central feed chute such that six feed chutes are in the vertical plane at the point where they meet the central feed chute and said six feed chutes slope gradually into the horizontal plane at the point said six chutes meet a cap receiver means comprising an improvement wherein none of the chutes have a width that is as wide as two diameters of the caps being fed in said chutes where the chutes in the manifold are as wide as the plunger cap diameter plus $\frac{1}{8}$ diameter for the vertical drop in the chutes and are as wide as the plunger cap diameter plus $\frac{1}{8}$ diameter for clearance for the horizontal travel in the two or more feed chutes; and wherein said cap manifold starting from the first chute on one side closest to the central feed chute wherein the additional chutes are pitched an additional diameter of the plunger caps for each succeeding chute such that the second chute is one diameter lower from the point of initial vertical descent in the first chute as compared to the point of initial vertical descent in the first chute where the first chute is connected to the central chute and a similar relation exists between each succeeding chute and the chute before it for the six chutes going to the cap receiver means.

20. The improved manifold apparatus of claim 19, wherein air pressure is intermittently applied on the plunger caps in said cap manifold so that the caps are forced with a positive pressure out of said six feed chutes.

* * * * *